US009340963B2

(12) United States Patent
Ito et al.

(10) Patent No.: US 9,340,963 B2
(45) Date of Patent: May 17, 2016

(54) TRANSPORTABLE RESTROOM

(71) Applicant: Bertram Y. Ito, Pearl City, HI (US)

(72) Inventors: Bertram Y. Ito, Pearl City, HI (US); Jesus J. Peña, Yorba Linda, CA (US)

(73) Assignee: Bertram Y. Ito, Pearl City, HI (US)

( * ) Notice: Subject to any disclaimer, the term of this patent is extended or adjusted under 35 U.S.C. 154(b) by 297 days.

(21) Appl. No.: 13/759,803

(22) Filed: Feb. 5, 2013

(65) Prior Publication Data

US 2014/0215702 A1 Aug. 7, 2014

(51) Int. Cl.
*E03D 7/00* (2006.01)
*E04H 1/12* (2006.01)

(52) U.S. Cl.
CPC ..... *E03D 7/00* (2013.01); *E04H 1/1266* (2013.01)

(58) Field of Classification Search
CPC ..... E03D 7/00; E03D 1/00; E04H 1/1266; A47K 4/00
USPC ..... 4/321, 300, 323, 476, 664
See application file for complete search history.

(56) References Cited

U.S. PATENT DOCUMENTS 3,949,430 A 4/1976 Miller
4,031,572 A * 6/1977 Harding ..... 52/79.1
4,163,294 A * 8/1979 Patterson ..... 4/449
4,185,337 A 1/1980 Sargent
4,305,164 A 12/1981 Sargent
4,761,840 A * 8/1988 Harding ..... 4/664
4,776,631 A 10/1988 Sargent
4,805,660 A 2/1989 Antos
4,888,832 A 12/1989 Cameron
4,892,349 A 1/1990 Sargent
4,908,885 A 3/1990 Antos
4,944,048 A 7/1990 Sargent
4,974,899 A 12/1990 Sargent
5,031,249 A 7/1991 Sargent
5,056,166 A 10/1991 Sargent
5,060,320 A 10/1991 Sargent
5,073,994 A 12/1991 Sargent
5,318,275 A 6/1994 Sargent
5,363,510 A 11/1994 Chlebek
5,398,465 A * 3/1995 Tagg ..... E04H 1/1216 4/449
5,500,960 A * 3/1996 Tagg ..... E03D 5/01 4/318
5,513,395 A 5/1996 Chlebek
5,560,050 A * 10/1996 Tagg ..... 4/449
5,875,499 A 3/1999 Hoffman
6,158,061 A 12/2000 Cameron
6,164,214 A * 12/2000 Smorgon et al. ..... 108/53.5
6,189,161 B1 2/2001 Rijn
6,327,719 B1 * 12/2001 Lobertmann et al. ..... 4/449
6,430,757 B1 * 8/2002 Pohler ..... 4/321
6,438,902 B1 * 8/2002 Muller ..... 52/79.1
6,507,958 B1 * 1/2003 Tagg ..... 4/321

(Continued)

FOREIGN PATENT DOCUMENTS

JP 07292750 A * 11/1995

*Primary Examiner* — Tuan N Nguyen
*Assistant Examiner* — William R Klotz
(74) *Attorney, Agent, or Firm* — Shlesinger, Arkwright & Garvey LLP

(57) ABSTRACT

A transportable restroom comprises a skid; a clean water tank and a waste water tank disposed on the skid, the clean water tank and said waste water tank being joined together to form a base; walls extending from the base including a door; roof supported by the walls; and a toilet disposed over the waste water tank.

31 Claims, 13 Drawing Sheets

(56) References Cited

U.S. PATENT DOCUMENTS

| | | | | |
|---|---|---|---|---|
| 6,804,840 | B2 | 10/2004 | Berman | |
| 6,871,361 | B2 | 3/2005 | Grech | |
| 7,293,298 | B2 | 11/2007 | Cameron | |
| 7,373,757 | B2 * | 5/2008 | Hampel | 52/79.1 |
| 7,765,625 | B2 | 8/2010 | Durrani | |
| 7,861,331 | B2 | 1/2011 | Grech | |
| RE42,688 | E | 9/2011 | Stegall | |
| 8,176,577 | B2 | 5/2012 | Grech | |
| 8,230,531 | B2 | 7/2012 | Miller | |
| 8,276,218 | B2 | 10/2012 | Grech | |
| 8,904,571 | B2 * | 12/2014 | Moore | E03D 5/016 4/317 |
| 2003/0024191 | A1 * | 2/2003 | Hampel | 52/309.1 |
| 2005/0241055 | A1 * | 11/2005 | Mullett et al. | 4/476 |
| 2006/0277675 | A1 * | 12/2006 | Tinnell | 4/477 |
| 2008/0184471 | A1 * | 8/2008 | Hampel | 4/479 |
| 2009/0100585 | A1 * | 4/2009 | Roberts | 4/317 |
| 2011/0030802 | A1 * | 2/2011 | Moore | 137/1 |
| 2012/0167297 | A1 * | 7/2012 | Poust | 4/321 |
| 2013/0167293 | A1 * | 7/2013 | Nakaya | 4/321 |
| 2014/0143945 | A1 * | 5/2014 | Chen et al. | 4/321 |

* cited by examiner

TRANSPORTABLE RESTROOM

FIELD OF THE INVENTION

The present invention is generally directed to portable toilets and in particular to transportable toilets for temporary use in places where municipal sewer hookups are not available.

SUMMARY OF THE INVENTION

The present invention provides a transportable restroom comprising a skid; a clean water tank and a waste water tank disposed on the skid, the clean water tank and said waste water tank being joined together to form a base; walls extending from the base including a door; roof supported by the walls; and a toilet disposed over the waste water tank.

The present invention also provides a base for a transportable restroom, comprising a skid; a clean water tank including a first top wall for use with the transportable restroom; a waste water tank including a second top wall for use with the transportable restroom, the waste water tank being nested to the clean water tank and disposed over the skid to form the base; and the first top wall and the second top wall are substantially aligned when the clean water tank is nested with the waste water tank.

DETAILED DESCRIPTION OF THE INVENTION

Figure 1:
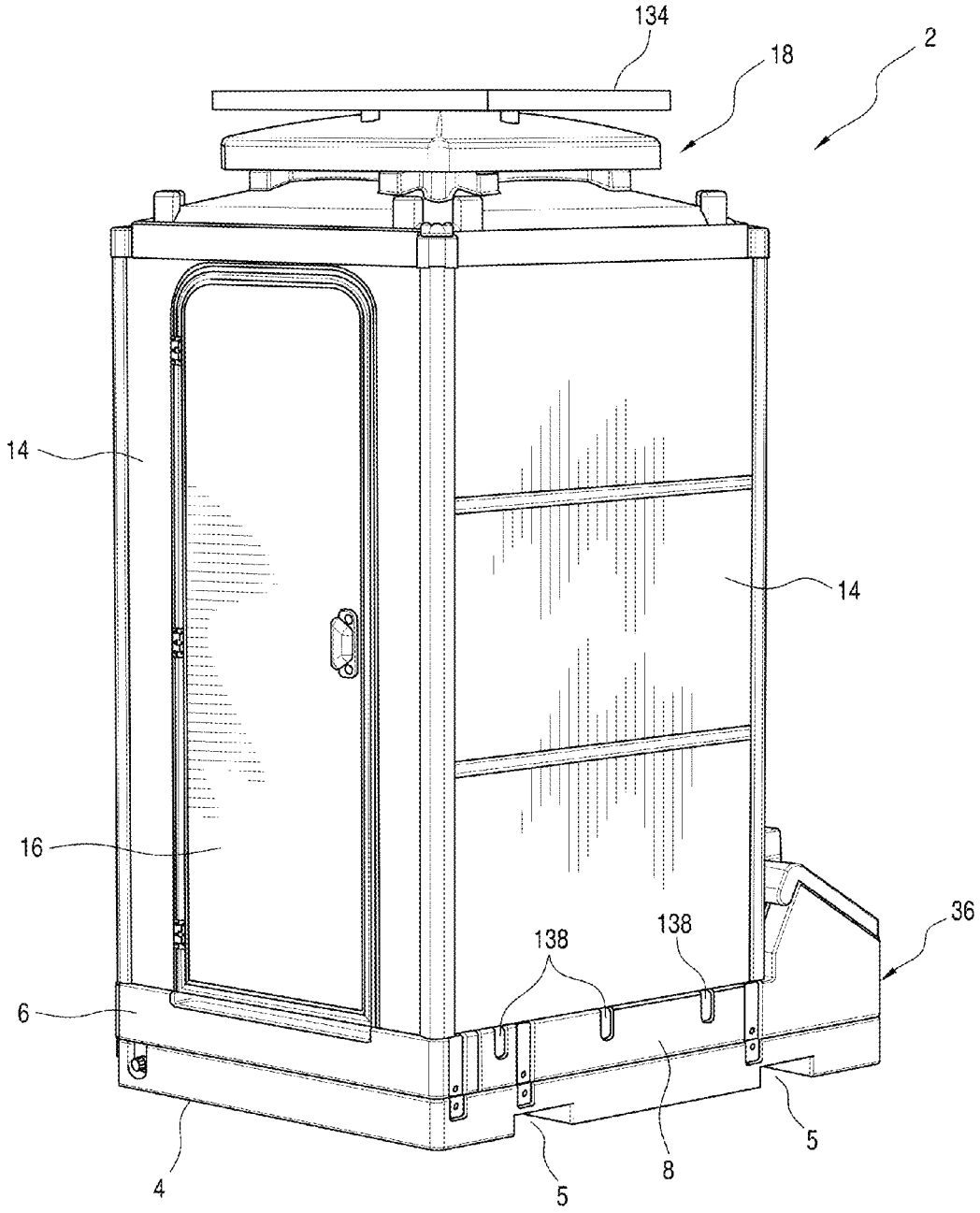
FIG. 1 is a perspective view of a transportable restroom embodying the present invention.
Figure 2:
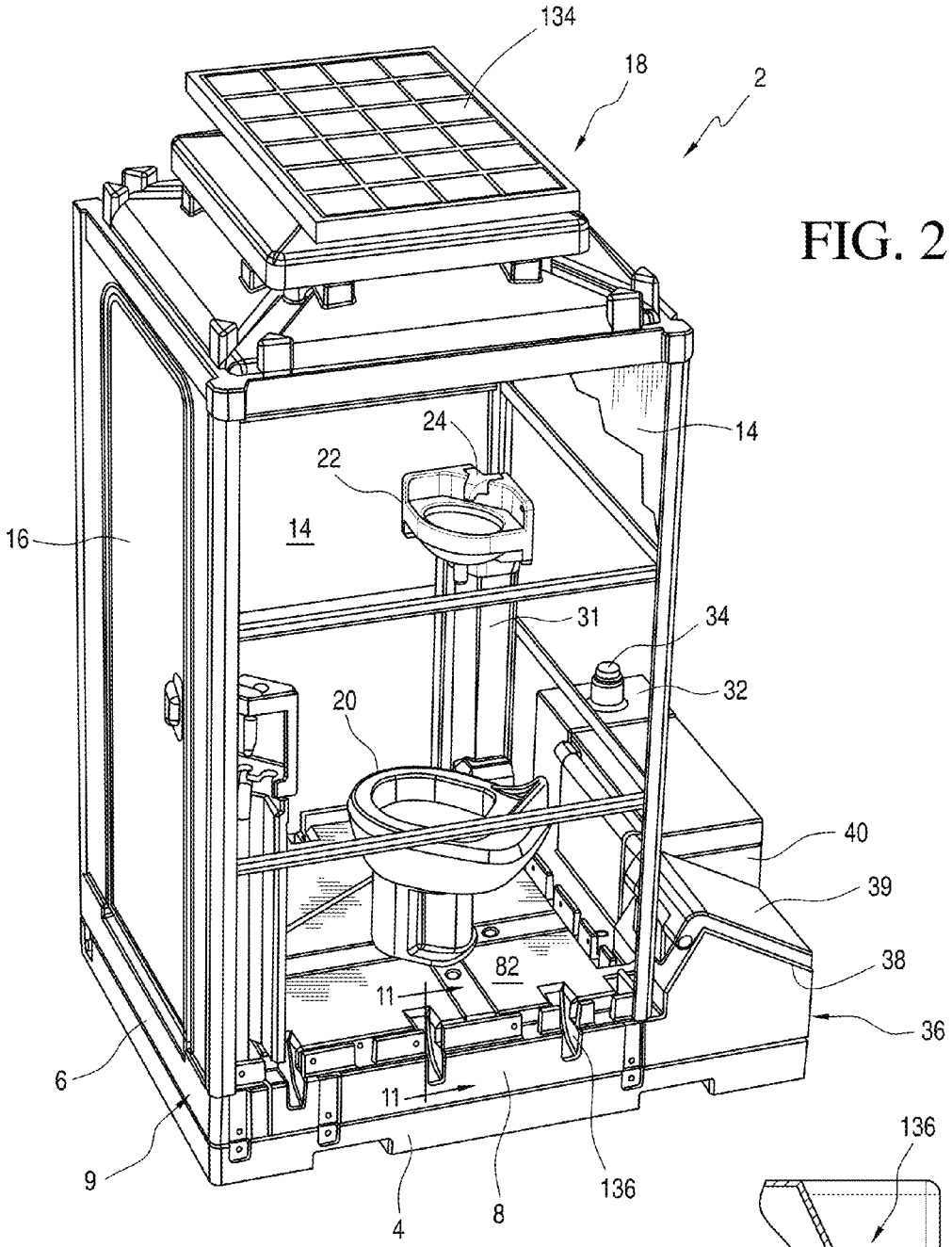
FIG. 2 is a perspective view of the transportable restroom with walls cut out to show interior details.
Figure 11:
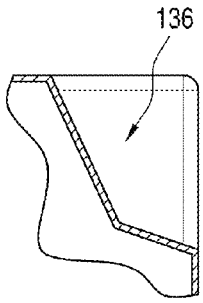
FIG. 11 is a cross-sectional view taken along line 11-11 in FIG. 2.
Figure 3:
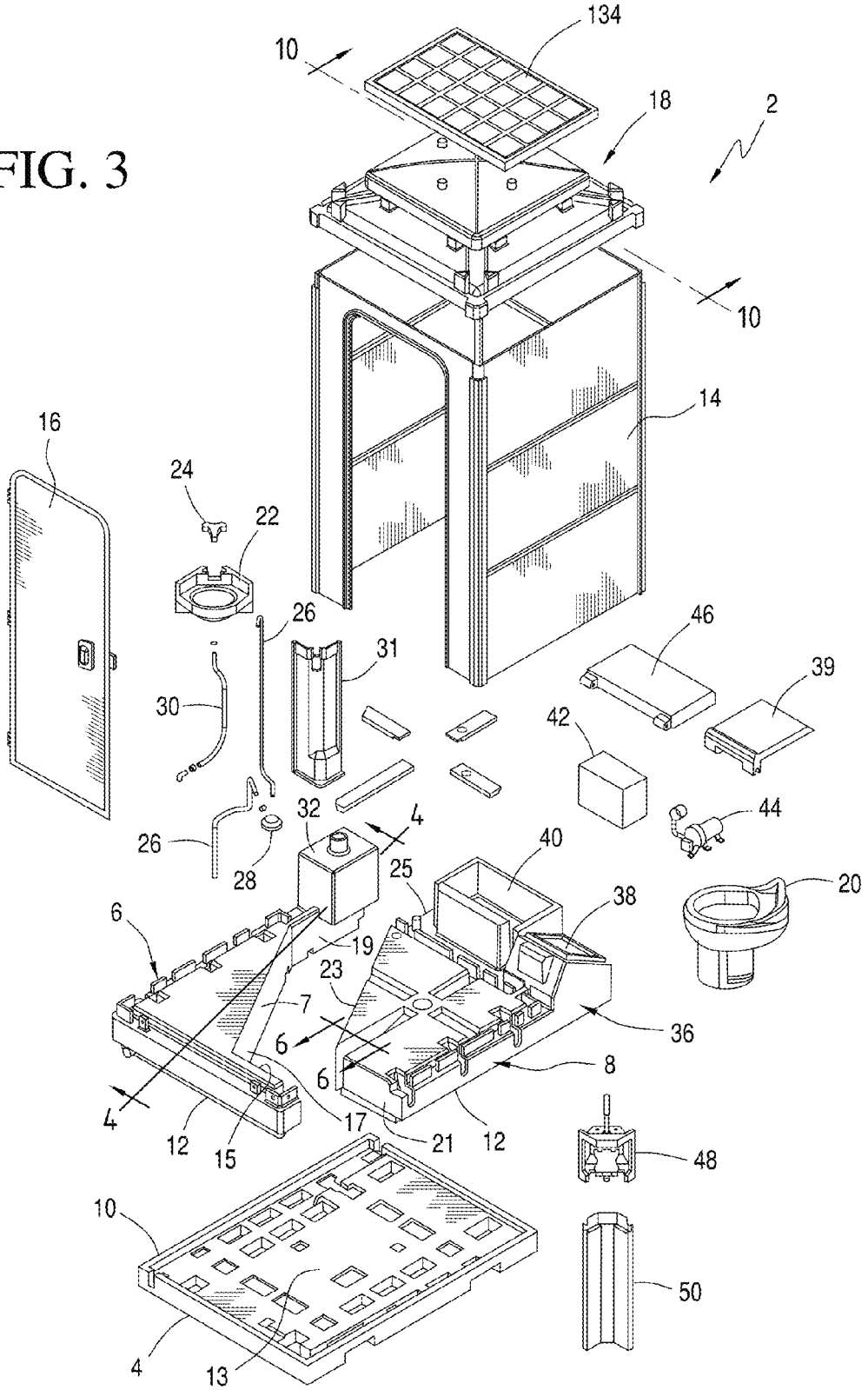
FIG. 3 is an assembly view of the transportable restroom of FIG. 1.

Referring to FIGS. 1, 2 and 3, a transportable and self-contained restroom 2 embodying the present invention is disclosed. The restroom 2 includes a skid 4 configured for lifting by a standard forklift (not shown) for loading onto and unloading from a truck for transport to a site where the restroom 2 is to be used. The skid 4 includes slots 5 for receiving the lifting arms of the forklift. The forklift may also be used for positioning the restroom 2 at a specific location at the site. A clean water tank 6 and a waste water tank 8 are disposed on the skid 4. The clean water tank 6 and the waste water tank 8 are separate and independent from each other so that a leak in one tank will not affect the other tank. The tanks 6 and 8 nest or mate together over the skid 4 to form a substantially rectangular base 9 for the restroom 2.

The capacity of the waste water tank 8 is advantageously larger than the capacity of the clean water tank 6. For example, the clean water tank 6 and the waste water tank 8 may be configured to have volume capacities substantially in the ratio of 40/60. In the embodiment disclosed, the capacity of the clean water tank 6 is approximately 43.5 gal and the waste water tank 8 approximately 73.3 gal. This allows for the accumulation of the water, urine and solid waste to fill the waste water tank 8 as the water supply is depleted at approximately the same rate.

The weight of the clean water tank 6 or the waste water tank 8 when full and their lower location with respect to the ground advantageously anchor the restroom to the ground and advantageously provide a lower center of gravity for the restroom 2 for stability.

The clean water tank 6 includes a slot 7 into which the waste water tank is nested. The slot 7 includes sides 15, 17 and 19. The waste water tank 8 includes sides 21, 23 and 25 that mate with the corresponding sides 15, 17 and 19 of the clean water tank 6. The vertical walls on the sides 17 and 23 when they are nested together advantageously provide additional load bearing strength for a user standing on or near the side 17 and 23 to resist shear and compression loads. The sides 17 and 23 are advantageously transverse to the diagonal 113 (see FIG. 9) so that a user standing in front of the toilet 20 would be positioned close to the side 17 and 23, thereby providing additional support to the supports 56 (see FIG. 4).

The skid 4 includes a peripheral flange 10 that mates with a peripheral step 12 along the outer bottom edges of the tanks 6 and 8. The flange 10 advantageously keeps the tanks 6 and 8 contained within the outer boundary of the skid 4. The skid 4 includes a depression 13 bounded by the peripheral flange 10. The bottom portion of the clean water tank 6 and the waste water tank 8 sit within the depression.

Walls 14 including a door 16 extend from the base 9. A roof 18 is supported by the walls 14.

A toilet 20 is disposed over the waste water tank 8. The toilet 20 is oriented along a diagonal of the base 9, as will be described further below. A handwash basin 22 with a spout 24 is attached to the walls 14 at an appropriate height. Water inlet line 26 is operably connected to the clean water tank 6 via a foot operated pump 28. A waste water line 30 drains the basin 22 into the waste water tank 8. A cover 31 hides the lines 26 and 30 for aesthetics.

The clean water tank 6 includes a portion 32 that extends outside the walls 14 and is, therefore, accessible from the outside. The portion 32 includes a refill inlet 34 for filling and refilling the clean water tank 6 without going inside the restroom 2.

The waste water tank 8 includes a portion 36 that extends outside the walls 14 and is, therefore, accessible from the outside. The portion 36 includes an opening 38 into the interior of the waste water tank 8 for emptying of the accumulated waste water and for cleaning. A cover 39 seals the opening 38 to keep odors in. The portion 36 also includes a housing 40 for a battery 42 and a pump 44. The housing 40 includes a cover 46 for access to the battery 42 and the pump 44. The pump 44, powered by the battery 42, is used to refill the bowl of the toilet 20 with clean water after each use. The pump 44 is operably connected to the clean water tank 6. Alternatively, a manual pump 48 may be used for refilling the toilet. A cover 50 hides the lines connecting the pump 48 to the clean water tank 6 and the toilet 20 to provide a clean look to the user.

Figure 4:
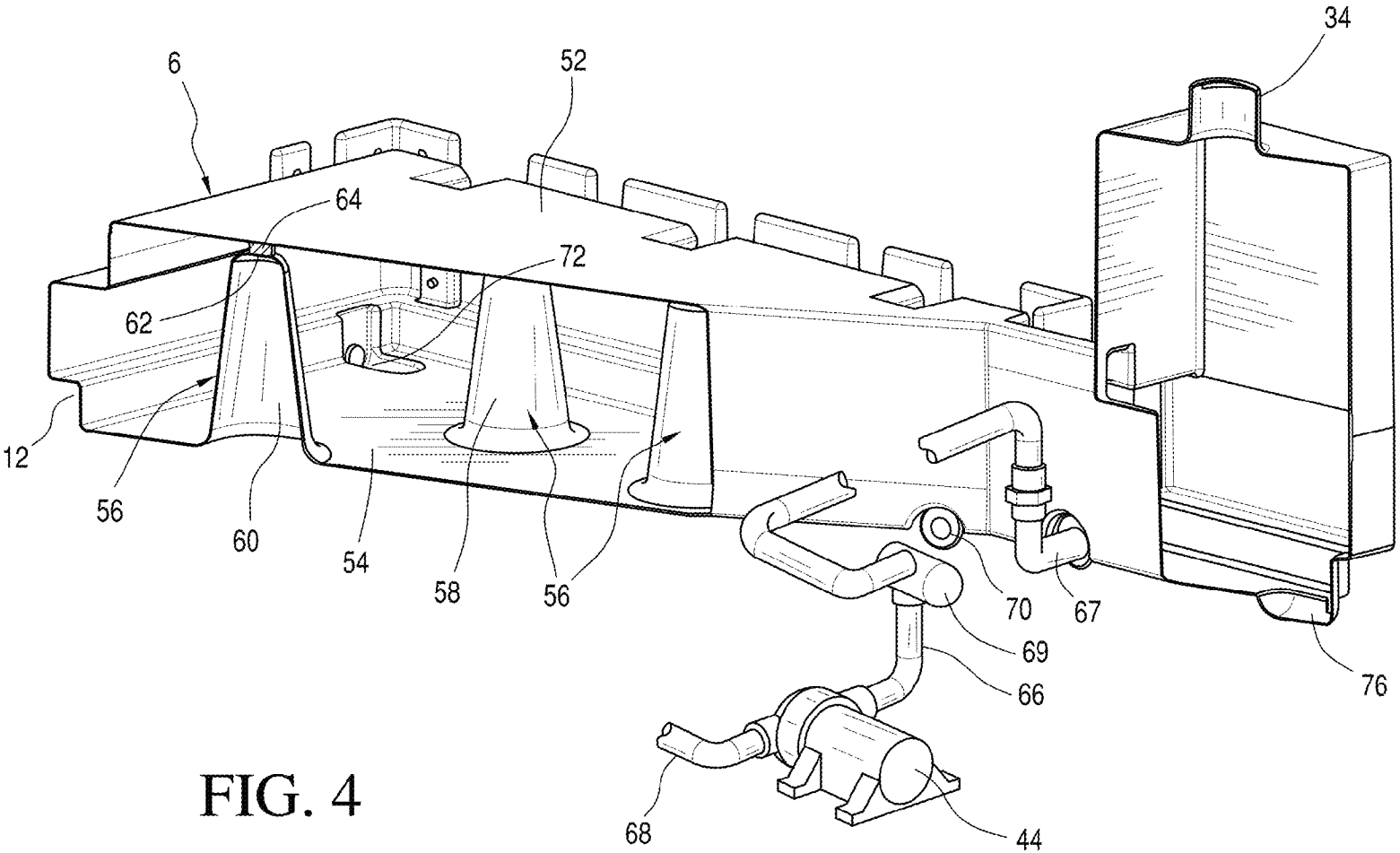
FIG. 4 is a cross-sectional view taken along line 4-4 in FIG. 3.

Referring to FIG. 4, the clean water tank 6 includes a top wall 52 and a bottom wall 54 joined to each other by a plurality of supports 56, preferably conical in shape. The load on the top wall 52, generally imposed by a person standing in front of the toilet 20, is advantageously transferred to the bottom wall 54 and the skid 4 and thence to the ground on which the restroom 2 sits. The supports 56 are advantageously truncated cones in shape, with the narrower portion being connected to the top wall 52 and the wider portion to the bottom wall 54. The supports 56 are hollow, with outer surface 58 being disposed within the interior of the clean water tank 6, and inner surface 60 being in communication with the outside. The truncated end portions 62 of the supports 56 are attached to the underside of the top wall 52 by a bridge member 64 for effective transfer of force to the bottom wall 54.

Still referring to FIG. 4, a water line 66 connects the pump 44 to the clean water tank 6 at 67 via a check valve 69. A line 68 connects the pump 44 to a valve (not shown) for refilling the bowl of the toilet 20 after each use. An outlet 70 is used to connect the water line 26 to the handwash basin 22. A capped outlet 72 is used to drain the water from the tank 6 for easier transport to the warehouse after use at the site is finished. Another capped outlet 76 is disposed in the extension portion 36.

Figure 5:
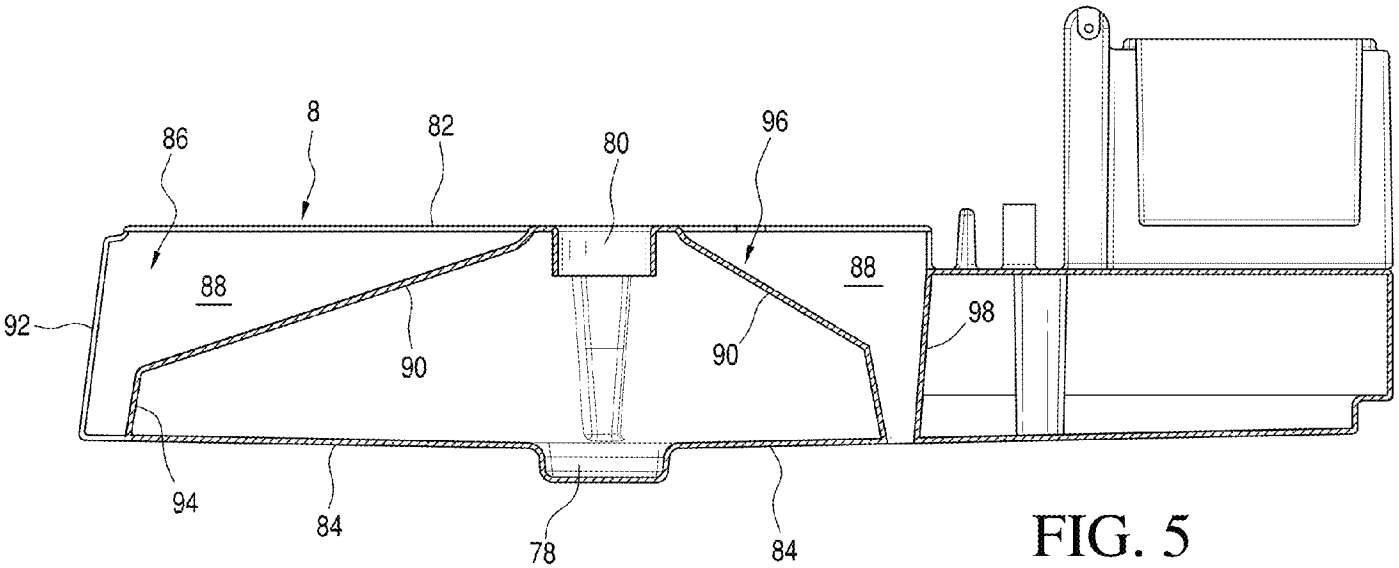
FIG. 5 is a cross-sectional view taken along line 5-5 in FIG. 9.

Referring to FIG. 5, the waste water tank 8 includes a sump 78 for effective cleaning. The toilet 20 sits over an opening 80 through the top wall 82. The waste water tank 8 has a bottom wall 84 that advantageously slopes toward the sump 78 so the accumulated waste can be easily vacuumed by directing the vacuum hose at the sump 78. Rinse water from spraying the interior of the tank 8 would also drain toward sump 78 for easier vacuuming. The opening 80 is advantageously disposed directly above the sump 78 so that the solid waste from the toilet 20 is advantageously deposited on or about the sump 78 for easier cleaning.

Figure 6:
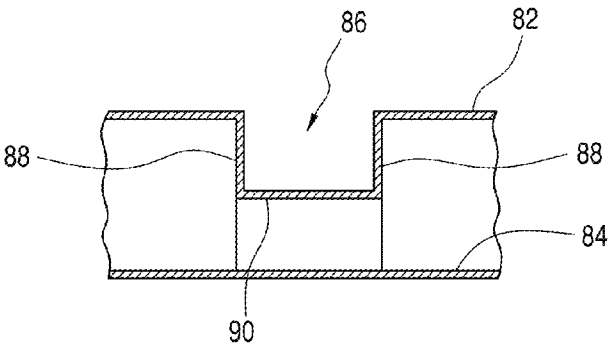
FIG. 6 is a cross-sectional view taken along line 6-6 in FIG. 3.
Figure 7:
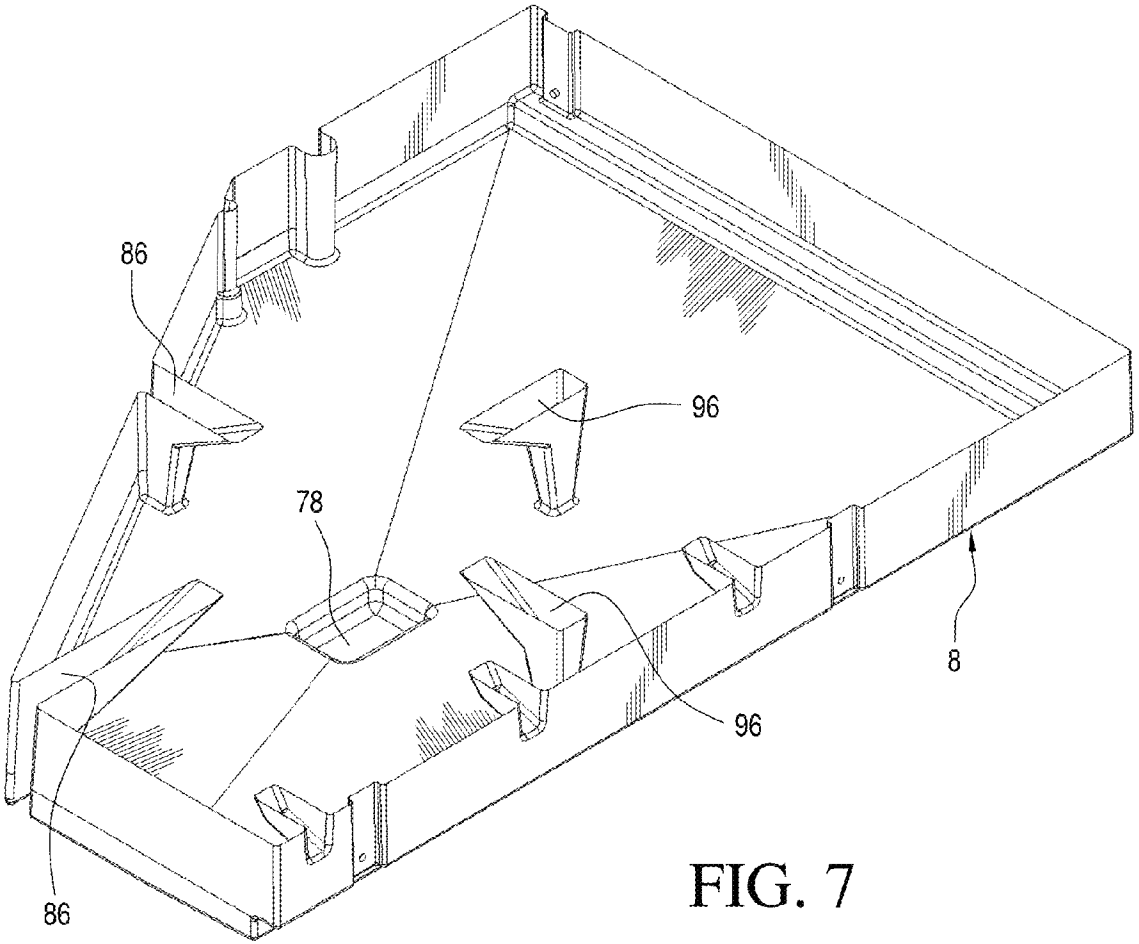
FIG. 7 is a perspective of a waste water tank embodying the present invention, shown with its top wall removed to reveal its interior space.

Referring to FIGS. 5, 6, and 7, the top wall 82 includes a number of supports 86 that transfer the load of a person sitting on the toilet 20 to the bottom wall 84, which is supported by the skid 4. The support 86 is U-shaped in cross-section with opposed side walls 88 and a bottom wall 90, which slopes downwardly away from the opening 80 towards the outer vertical wall 92. The bottom wall 90 terminates into a wall 94, which is transverse to the bottom wall 84.

Additional supports 96 are shown that are similar to the support 86, with opposed side walls 88, sloping bottom wall 90 and transverse wall 94, but with the addition of a vertical wall 98 joined to the side walls 88. The support 96 connects to the bottom wall 84.

Referring to FIG. 7, it will be seen that the waste water tank 8 is substantially obstruction-free, except for the centrally located support 96. However, when the rinse wand is directed toward that area, the rinse water being splashed and sprayed in all directions will eventually rinse the area behind the centrally located support 96. In addition, rinse water making its way to the low point sump 78 will help to rinse that area.

Referring back to FIG. 2, access opening 38 is disposed higher than the top wall 82 and inclined downwardly away from the back wall 14 to provide a longer sightline into the interior of the waste water tank 8 and, therefore, a longer reach of the vacuum hose and the cleaning wand during cleaning.

Figure 8:
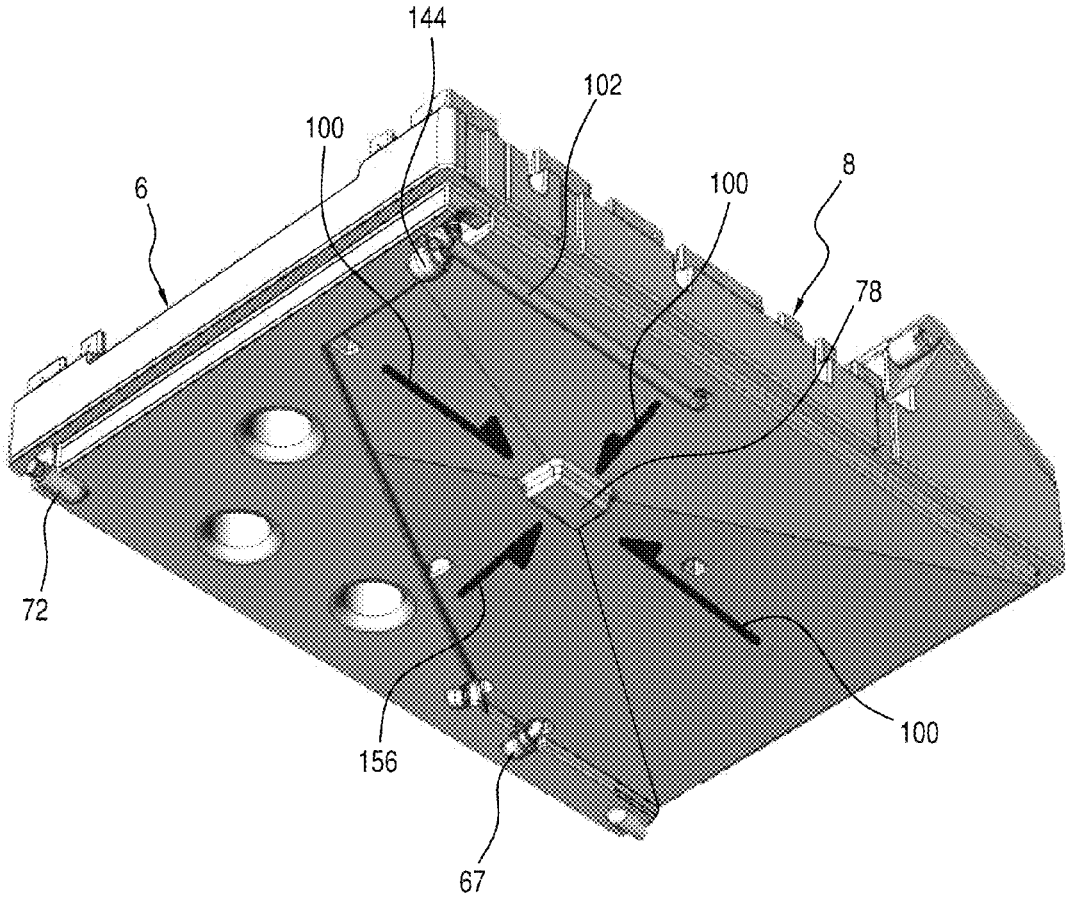
FIG. 8 is a bottom perspective view of a clean water tank and a waste water tank nested together.

Referring to FIG. 8, arrows 100 show the direction of flow of the waste water toward the sump 78. The bottom wall 84 is advantageously slanted from the horizontal toward the sump 78 to cause the waste water to flow toward the sump 78. A water line 102 connected to the clean water tank 6 is disposed below the waste water tank 8 to connect to the toilet 20.

Figure 9:
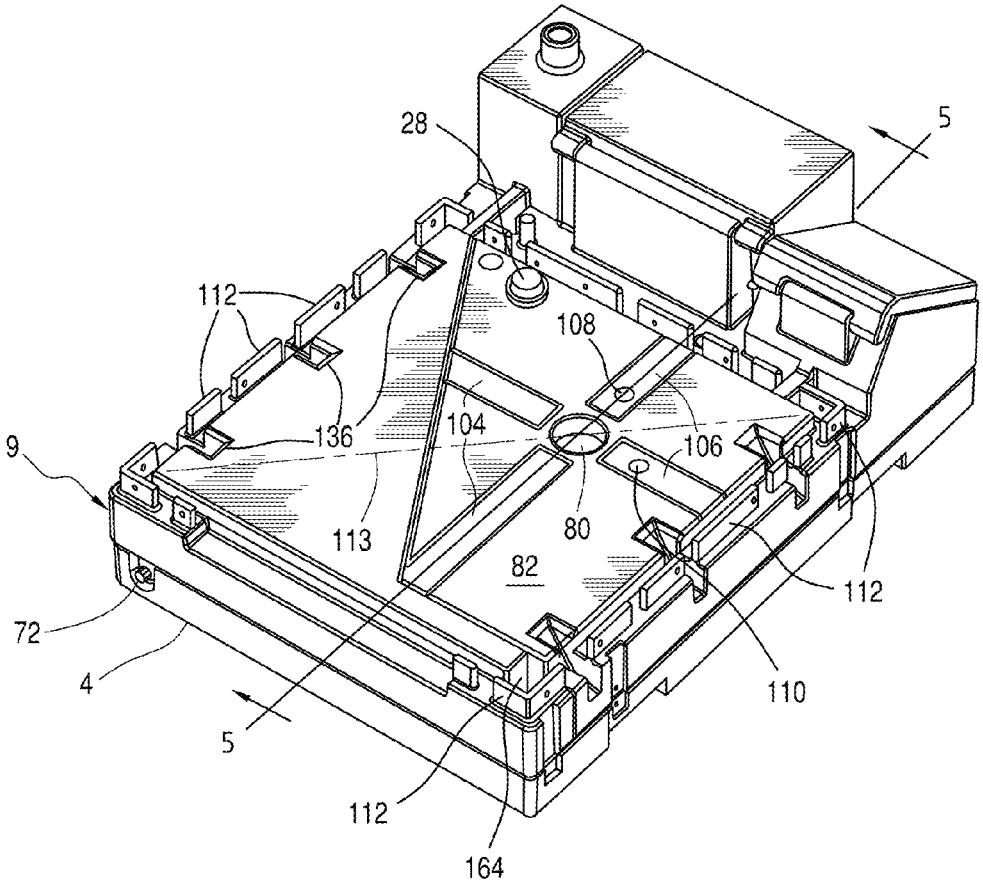
FIG. 9 is a top perspective view of a clean water tank and a waste water tank nested together.

Referring to FIG. 9, covers 104 and 106 are used to cover the cavities created by the supports 86 and 96 to provide a substantially flat surface over the top wall 82. The covers 106 include openings 108 and 110 for routing the clean water line coming from the electric pump 44 or the manual pump 48 for refilling the toilet 20. The hole 108 is for routing the clean water line from the electric pump 44 for the embodiment that uses the pump 44. The hole 110 is for routing the water line 102 from the manual pump 48 for the embodiment that uses the manual pump 48.

Tabs 112 are used to secure the walls 14 to the clean water tank 6 and the waste water tank 8. The base 9 may be used as a retrofit for existing portable toilets, wherein the existing wall and roof of the existing toilet may be reused over the base 9. A floor cover panel (not shown) extending over the clean water tank 6 and the waste water tank 8 may be added to create a one piece surface for cleanability and visual appearance and helps to enhance load bearing capability by spreading the load over a larger surface.

The hole 80 as shown in FIG. 9 is preferably disposed on a diagonal 113, which is the longest dimension on the base 9. The toilet 20 is preferably oriented along the diagonal 113, as shown in FIG. 2, so that the front portion and the rear portion of the toilet 20 are substantially aligned along the diagonal 113. This arrangement advantageously provides relatively more room to a user standing in front of the toilet 20. The orientation and location of the toilet 20 also frees up the other two corners where the handwash basin 22 and the manual pump 48 are respectively disposed.

Figure 10:
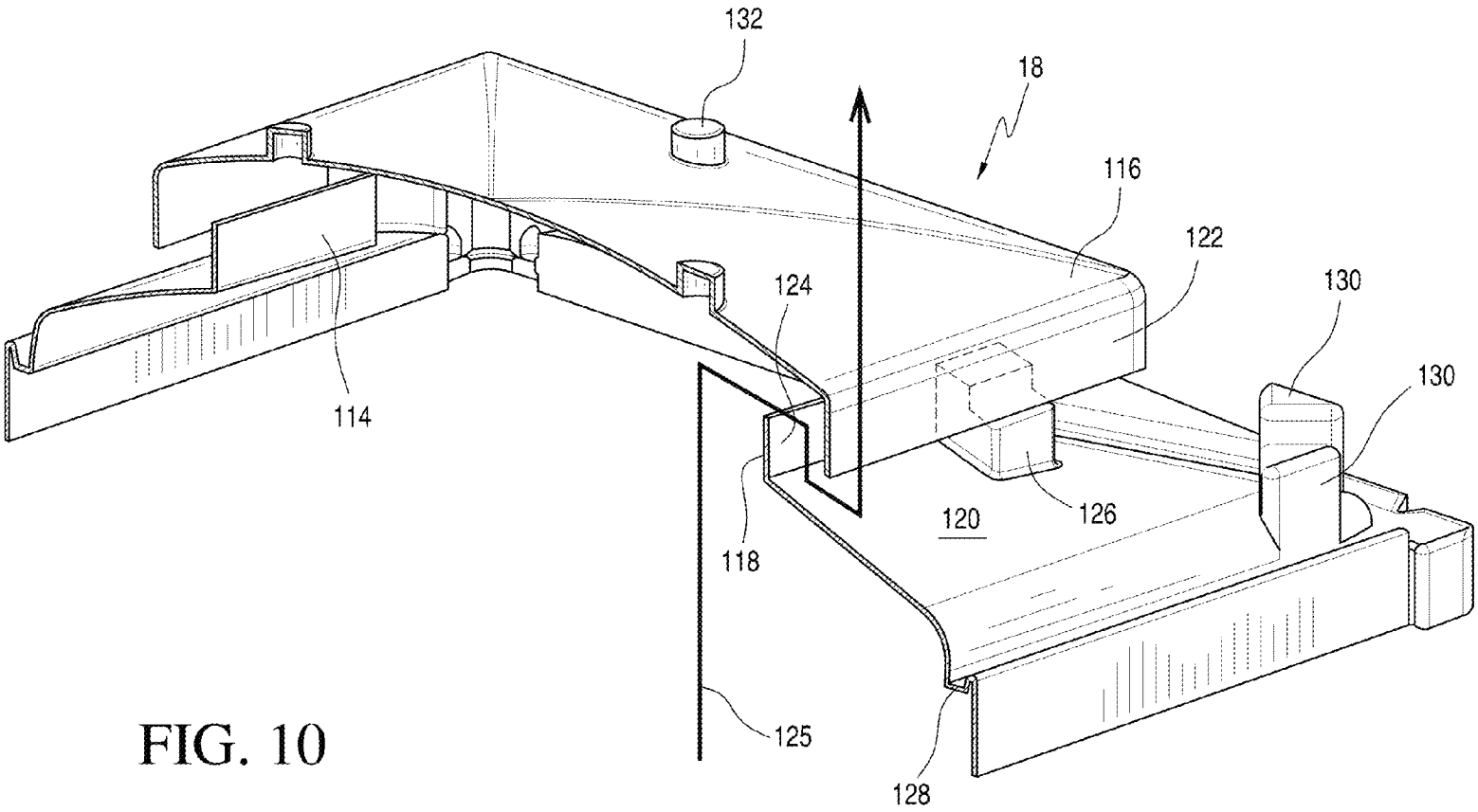
FIG. 10 is a perspective cross-sectional view taken along line 10-10 in FIG. 3 of a roof of the transportable restroom shown in FIG. 1.

Referring to FIG. 10, the roof 18 includes an opening 114 and a cap 116 over the opening 114. The roof includes a peripheral flange 118 around the opening 116. The flange 118 is disposed vertically from the roof wall 120. The cap 116 includes a peripheral flange 122 disposed opposed from the flange 118 and above the roof wall 120 to define an air passageway 124 generally depicted by a directional arrow 125. Mounting supports 126 attached to the roof wall 120 provide support for the cap 116. The vertical flanges 118 and 122 advantageously prevent driving rain water from penetrating the vent passageway depicted by the arrow 124.

The roof wall 120 advantageously slopes downwardly toward a gutter 128 disposed around the four sides of the roof 18 and advantageously directs any rain water toward the corners of the roof 18. Tie-down piers 130 are provided at the four corners of the roof 18 for securing hold-down straps (not shown) when the restroom 2 is being transported at the back of an open truck bed. Mounting supports 132 are used for attachment of a solar panel 134. The solar panel 134 is preferably disposed horizontally, rather than being inclined, so that the active surface of the solar panel is advantageously exposed to the sun during the daytime regardless of the direction the restroom 2 may be facing at the site.

Referring to FIGS. 1, 2, 9 and 11, slots 136 are provided along two opposite outer edges of the base 9, although providing the slots 136 along one outer edge of the base 9 would also work. The slots 136 communicate with interior of the restroom 2 and the outside. Inlet openings 138 that communicate with the interior of the restroom 2, as shown in FIG. 1, cooperate with the air passageway 124 through the roof 18 to ventilate the interior of the restroom 2. Through the process of convection, cooler air enters through the inlets 136, is heated within the restroom 2 and rises and exhausts through the air passageway 124 at the roof 18 to advantageously provide ventilation within the restroom 2. The slots 136 also advantageously function as water drains when the interior of the restroom 2 is sprayed with water for cleaning.

Figure 12:
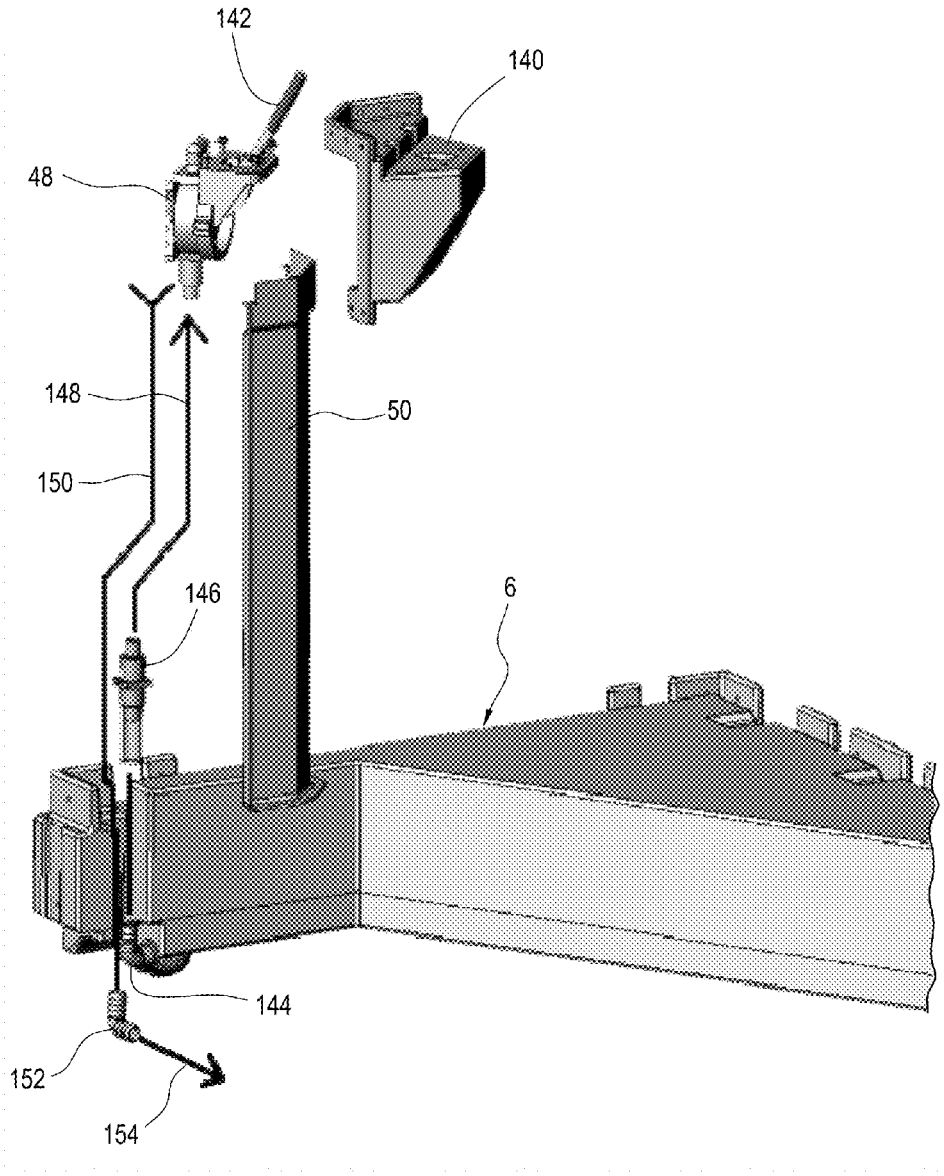
FIG. 12 is an assembly view of a clean water feed system using a manual pump for refilling the toilet after use.

Referring to FIG. 12, the manual pump 48 is attached to a mounting bracket 140, which is then attached to the wall 14. A handle 142 is used to operate the pump. The pump 48 is preferably a whale urchin hand pump. A hose fitting 144 is operably connected to the clean water tank 6 and to a check valve 146. A water line 148 is connected to the check valve 146 and to the inlet of the pump 48. Another water line 150 is connected to the outlet of the pump 48 and to an elbow 152 which is connected to another water line 154 (item 102 in FIG. 8) disposed underneath the waste water tank 8. The water line 154 is extended to the toilet 20.

Figure 13:
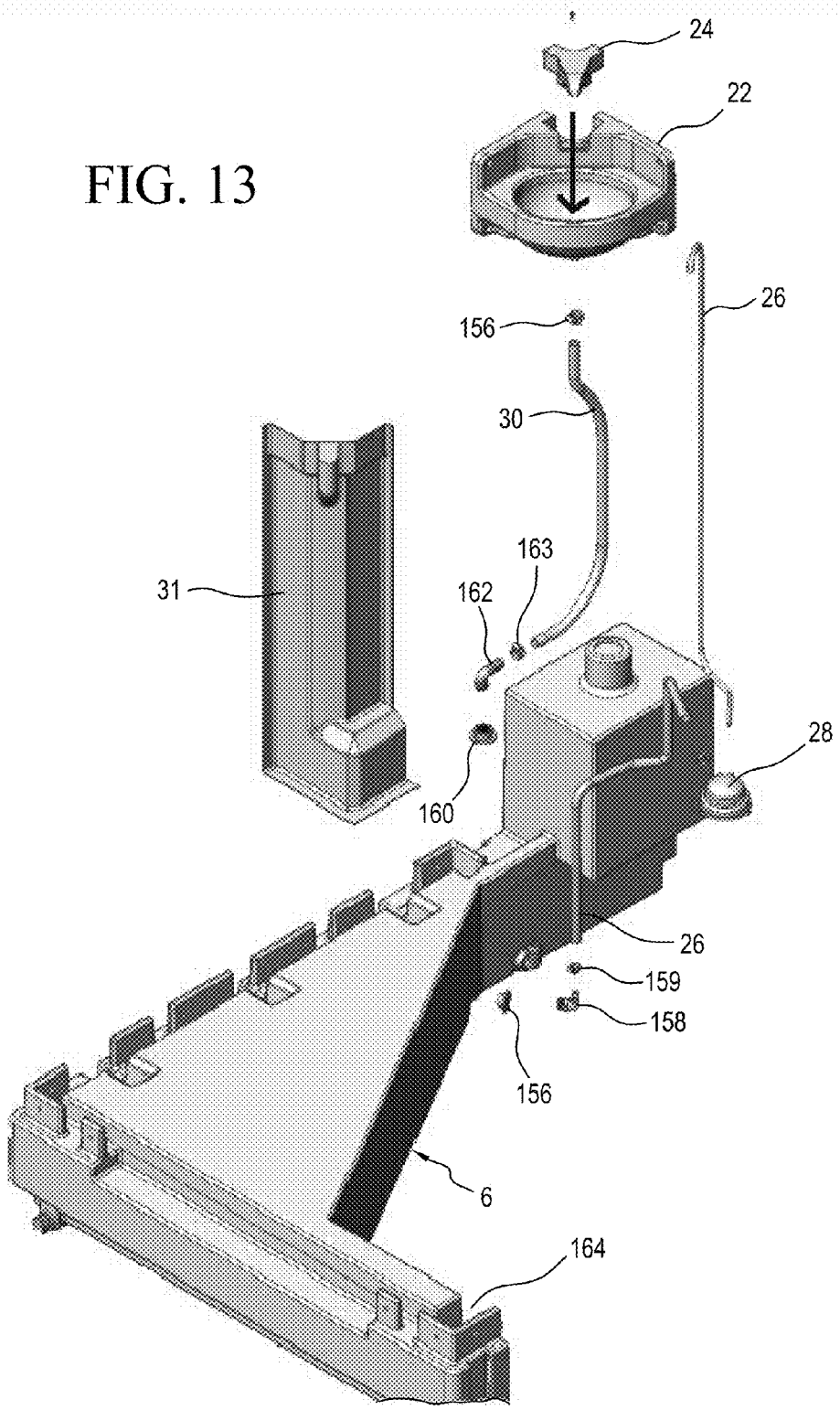
FIG. 13 is an assembly view of a clean water feed system for a handwash basin used in the transportable restroom shown in FIG. 1.

Referring to FIG. 13, the water line 26 is connected to the clean water tank 6 with a hose fitting 156 via the foot pump 28. An elbow 158 connects the fitting 156 to the line 26 with a clamp 159. The drain line 30 is connected to the wasted water tank 8 with a hose fitting 160. An elbow 162 connects the drain line 30 to the fitting 160 with a clamp 163. The drain line 30 is connected to the handwash basin 22 with a clamp 165.

A gap 164 between the clean water tank 6 and the waste water tank 8 (see also FIG. 9) provides space for the lines 148 and 150 as they are routed to the manual pump 48.

Figure 14:
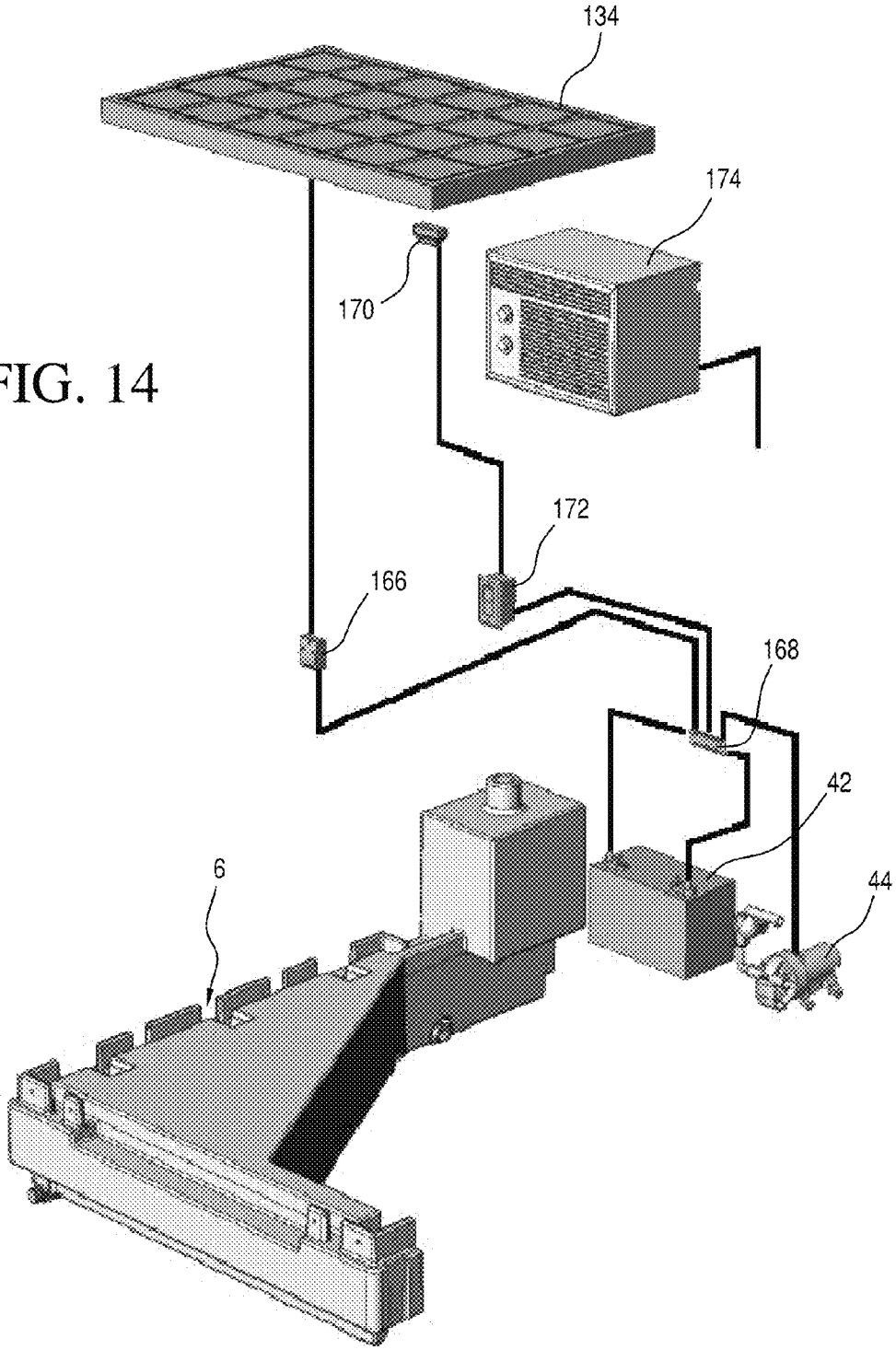
FIG. 14 is a perspective schematic view of the electrical system used in the transportable restroom shown in FIG. 1.
Figure 15:
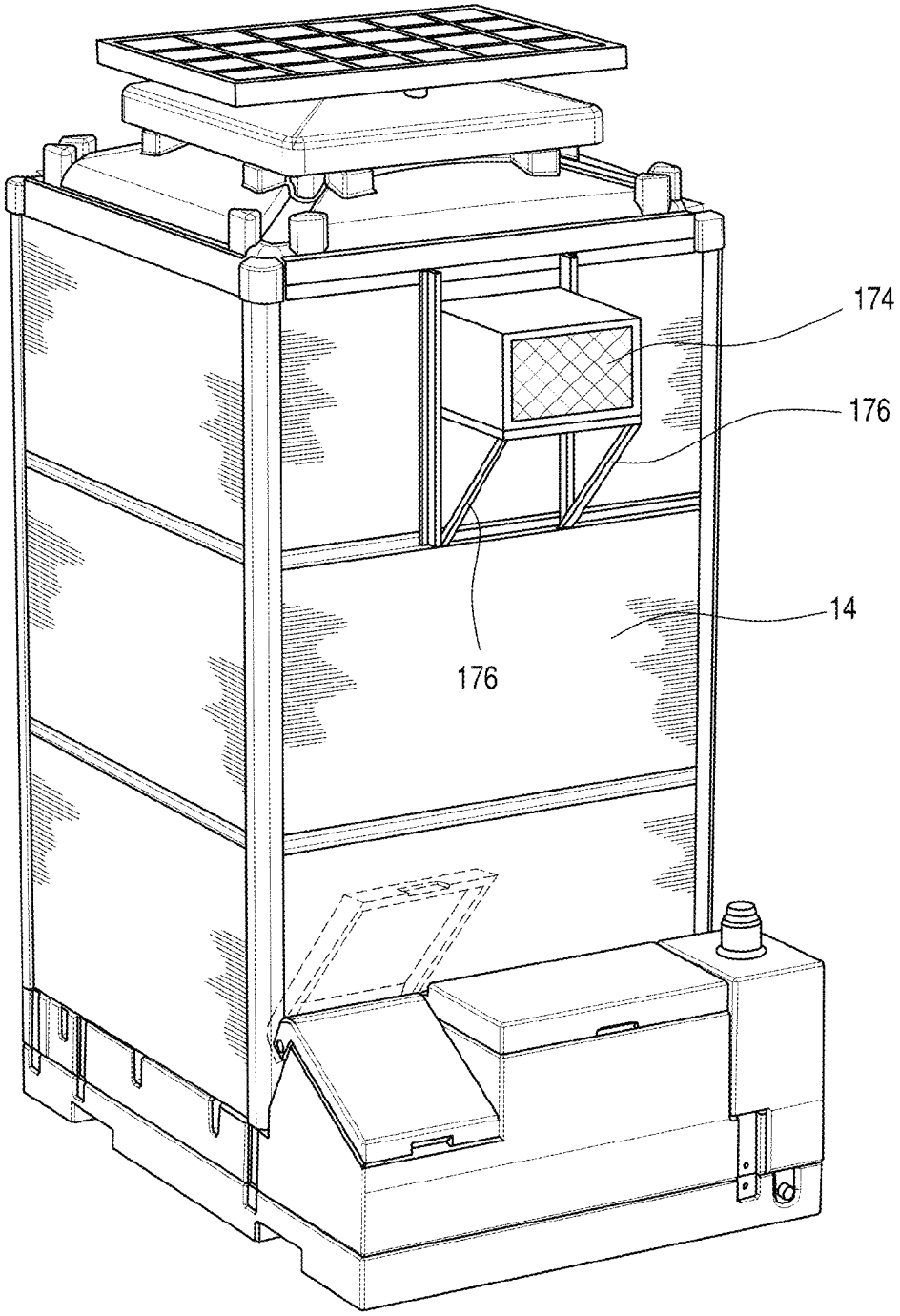
FIG. 15 is a rear perspective view of FIG. 1, showing an air-conditioning unit to be powered from the power grid.

Referring to FIG. 14, the solar panel 134 charges the battery 42 via a solar regulator 166. A bus 168 connects the battery 42 to the pump 44 and an LED light 170 via an infrared/motion activated switch 172. An air-conditioning unit 174 may be provided to cool the interior of the restroom 2 when grid power is available. The air-conditioning unit 174 is supported by standard brackets 176 attached to the wall 14.

The toilet 20 is a standard item. The battery 42 is utilized to automatically refill the toilet bowl. When the user presses the toilet pedal, the toilet fill valve opens which begins to fill and rinse the bowl while the flush valve also opens to evacuate the waste into the waste water tank 8. As the water valve is opened, the pump 44 is activated to refill the bowl. Once the bowl is filled and the pedal is released, the pump 44 stops pumping. The toilet 20 is now ready for the next cycle.

While this invention has been described as having preferred design, it is understood that it is capable of further modification, uses and/or adaptations following in general the principle of the invention and including such departures from the present disclosure as come within known or customary practice in the art to which the invention pertains, and as may be applied to the essential features set forth, and fall within the scope of the invention or the limits of the appended claims.

We claim:

1. A transportable restroom, comprising:

a) a skid;

b) a clean water tank and a waste water tank disposed over and supported by said skid, said clean water tank and said waste water tank being unattached from each other and nested together to form a base, said clean water tank and said waste water tank being separate and independent from each other;

c) said clean water tank including a first top wall, said waste water tank including a second top wall aligned with said first top wall when said clean water tank and said waste water tank are nested together;

d) walls extending from said base including a door;

e) roof supported by said walls; and f) a toilet disposed over said waste water tank.

2. A transportable restroom as in claim 1, wherein said base includes a periphery and air passageways are disposed along said periphery.

3. A transportable restroom as in claim 1, wherein said clean water tank has a volume capacity less than a volume capacity of said waste water tank.

4. A transportable restroom as in claim 3, wherein the ratio of said clean water tank to said waste water tank is about 40/60.

5. A transportable restroom as in claim 1, wherein:

a) a portion of said waste water tank extends outside said walls; and b) an access opening is disposed on said portion.

6. A transportable restroom as in claim 1, wherein:

a) a portion of said clean water tank extends outside said walls; and b) an inlet for filling said clean water tank is disposed on said portion.

7. A transportable restroom as in claim 5, wherein a battery holder is disposed on said portion.

8. A transportable restroom as in claim 1, wherein said clean water tank has a vertical wall that abuts a vertical wall of said waste water tank.

9. A transportable restroom as in claim 1, wherein:

a) said base is rectangular with a diagonal; and b) said toilet has a front portion and a rear portion substantially aligned along said diagonal.

10. A transportable restroom as in claim 1, and further comprising a water line connected to said clean water tank for filling a bowl of said toilet after each use.

11. A transportable restroom as in claim 10, wherein said water line is connected to a manual pump.

12. A transportable restroom as in claim 11, wherein said water line is disposed below said waste water tank.

13. A transportable restroom as in claim 10, wherein said water line is connected to an electric pump.

14. A transportable restroom as in claim 1, wherein:

a) said roof includes an opening; and b) a cap disposed over and spaced apart from said opening.

15. A transportable restroom as in claim 14, wherein:

a) said opening includes a peripheral vertically upwardly directed flange;

b) said cap includes a peripheral vertically downwardly directed flange disposed apart and opposed to said peripheral vertically upwardly directed flange.

16. A transportable restroom as in claim 1, wherein said roof includes a gutter.

17. A transportable restroom as in claim 1, wherein said roof includes piers disposed at corners of said roof for tying down the restroom during transport on a vehicle.

18. A transportable restroom as in claim 1, and further comprising a solar panel disposed on said roof.

19. A transportable restroom as in claim 14, and further comprising a solar panel disposed on said cap.

20. A transportable restroom as in claim 1, and further comprising:

a) a handwash basin having a clean water line supply operably connected to said clean water tank;

b) a waste water line operably connected to said waste water tank; and c) a foot pump for pumping water from said clean water tank to said handwash basin.

21. A transportable restroom as in claim 1, wherein:

a) said clean water tank includes a top wall and a bottom wall; and b) a plurality of supports disposed between said top wall and said bottom wall.

22. A transportable restroom as in claim 21, wherein said supports include truncated cones.

23. A transportable restroom as in claim 1, wherein:

a) said waste water tank includes a top wall and a bottom wall;

b) said top wall includes an opening in communication with said toilet; and c) said top wall includes a plurality of supports between said opening and said bottom wall.

24. A transportable restroom as in claim 23, wherein:

a) said supports each includes opposed side walls and descending base wall; and b) said base wall includes a vertical portion at a bottom portion of said base wall.

25. A base for a transportable restroom, comprising:

a) a skid including a periphery, a flange extending upwardly around said periphery;

b) a clean water tank for use with the transportable restroom;

c) a waste water tank for use with the transportable restroom, said waste water tank being separate and independent from said clean water tank, said waste water tank being unattached and nested to said clean water tank;

d) said clean water tank and said waste water tank being disposed over said skid to form a base, said clean water tank and said waste water tank being supported by said skid;

e) said clean water tank and said waste water tank when nested together including an outer peripheral step that mates with said flange; and f) said clean water tank including a first top wall, said waste water tank including a second top wall aligned with said first top wall when said clean water tank and said waste water tank are nested together.

26. A base for a transportable restroom as in claim 25, wherein:

a) said clean water tank includes a slot; and b) said waste water tank is nested into said slot.

27. A base for a transportable restroom as in claim 25, wherein said clean water tank and said waste water tank when nested together form a substantially rectangular shape in plan view.

28. A base for a transportable restroom as in claim 26, wherein:

a) said slot includes first and second sides disposed transverse to each other and a third side disposed between said first and second sides; and b) said waste water tank includes first, second and third sides that mate with corresponding said first, second and third sides of said slot.

29. A base for a transportable restroom as in claim 25, wherein:

a) said waste water tank includes an opening for communicating with a toilet;

b) said base is substantially rectangular in plan view; and c) said opening is disposed on a diagonal of said base.

30. A transportable restroom, comprising:

a) a skid;

b) a clean water tank and a waste water tank supported by said skid, said clean water tank and said waste water tank being unattached from each other and nested together to form a base, said clean water tank and said waste water tank being separate and independent from each other;

c) said clean water tank including first and second sides disposed transverse to each other and a third side disposed between said first and second sides;

d) said waste water tank including first, second and third sides that mate with corresponding said first, second and third sides of said clean water tank when said clean water tank is nested with said waste water tank; and e) said clean water tank including a first top wall, said waste water tank including a second top wall aligned with said first top wall when said clean water tank and said waste water tank are nested together.

31. A transportable restroom as in claim 1, wherein said skid is one-piece construction.

* * * * *